US008505126B2

(12) United States Patent
Morotomi et al.

(10) Patent No.: US 8,505,126 B2
(45) **Date of Patent: *Aug. 13, 2013**

(54) SANITARY WASHING APPARATUS

(75) Inventors: Yo Morotomi, Fukuoka-ken (JP); Ayumu Umemoto, Fukuoka-ken (JP); Koichiro Matsushita, Fukuoka-ken (JP)

(73) Assignee: Toto Ltd., Kitakyushu-Shi (JP)

( * ) Notice: Subject to any disclaimer, the term of this patent is extended or adjusted under 35 U.S.C. 154(b) by 59 days.

This patent is subject to a terminal disclaimer.

(21) Appl. No.: 13/388,482

(22) PCT Filed: Jul. 29, 2010

(86) PCT No.: PCT/JP2010/062848

§ 371 (c)(1),
(2), (4) Date: Feb. 2, 2012

(87) PCT Pub. No.: WO2011/016389

PCT Pub. Date: Feb. 10, 2011

(65) Prior Publication Data

US 2012/0124730 A1 May 24, 2012

(30) Foreign Application Priority Data

Aug. 6, 2009 (JP) ..... 2009-183610

(51) Int. Cl.
*A47K 3/022* (2006.01)

(52) U.S. Cl.
USPC ..... 4/443

(58) Field of Classification Search
USPC ..... 4/443, 420.3, 444–448, 420.1–420.4, 4/615; 239/590
See application file for complete search history.

(56) References Cited

U.S. PATENT DOCUMENTS

| | | | | |
|---|---|---|---|---|
| 4,370,764 | A * | 2/1983 | Ando et al. | 4/443 |
| 5,954,939 | A | 9/1999 | Kanekuni et al. | |
| 5,970,528 | A * | 10/1999 | Shirai et al. | 4/420.2 |
| 6,754,912 | B1 | 6/2004 | Hayashi et al. | |
| 2006/0096017 | A1 * | 5/2006 | Yamasaki et al. | 4/420 |

FOREIGN PATENT DOCUMENTS

| | | | |
|---|---|---|---|
| JP | 2001-140323 | A | 5/2001 |
| JP | 2001140323 | A * | 5/2001 |
| JP | 3487447 | B2 | 10/2003 |
| JP | 3487447 | B2 * | 10/2003 |
| JP | 2008-196141 | A | 8/2008 |
| JP | 2008196141 | A * | 8/2008 |
| WO | 95/32922 | A1 | 12/1995 |

OTHER PUBLICATIONS

International Search Report for PCT/JP2010/062848 dated Sep. 7, 2010.

* cited by examiner

*Primary Examiner* — Lori Baker
(74) *Attorney, Agent, or Firm* — Pearne & Gordon LLP

(57) ABSTRACT

A sanitary washing apparatus includes a nozzle having a water discharge port, the nozzle being configured to wash a human private part by squirting water from the water discharge port, a flow channel configured to supply the water to the nozzle, a sterilizing water supply unit provided partway through the flow channel, the sterilizing water supply unit being capable of supplying sterilizing water, and a control unit configured to execute a physical washing process of washing the nozzle using water and a sterilizing process of sterilizing the nozzle using the sterilizing water after the washing the human private part. The washing nozzle can be sterilized more efficiently or a user's sense of cleanliness regarding the washing nozzle can be improved.

5 Claims, 6 Drawing Sheets

SANITARY WASHING APPARATUS

TECHNICAL FIELD

This invention relates to a sanitary washing apparatus.

BACKGROUND ART

A washing nozzle for private part washing is configured to squirt wash water onto private parts in a state in which at least a portion of the washing nozzle is exposed (advanced) outside a casing to which prescribed functional parts such as the washing nozzle, a warm water tank, etc., are mounted. Therefore, there is a risk that liquid waste and/or solid waste may adhere to the washing nozzle. Conversely, there exist sanitary washing apparatuses to rinse away and remove the liquid waste and/or the solid waste adhered to the washing nozzle prior to and after performing the private part washing. Thereby, the washing nozzle is kept clean.

However, even in the case where the liquid waste and/or the solid waste adhered to the washing nozzle are rinsed away, there are cases where bacteria propagates on the washing nozzle as time elapses in humid environments such as that of the toilet room. More specifically, there is a risk that, for example, bacteria such as methylobacterium called pink slime and the like and black mold, etc., that occur on the bowl face and the like of the toilet may adhere to the washing nozzle; and the bacteria may propagate on the washing nozzle. Then, for example, in the case where bacteria called biofilms and the like and collections of secretions of the bacteria (slime and black dirt) form due to the propagation of the bacteria, it becomes difficult to remove such biofilms in a normal nozzle wash such as that described above.

Conversely, a sanitary washing apparatus has been proposed in which an electrolytic cell is connected to a flow channel that supplies wash water; and the washing nozzle is sterilized such that biofilms do not form by regularly supplying water including hypochlorous acid produced by the electrolytic cell (Patent Citation 1). On the other hand, an electrolysis apparatus and an electrolysis method that produce water including hypochlorous acid have been proposed (Patent Citation 2).

However, there is room for improvement to efficiently sterilize the washing nozzle. For example, although hypochlorous acid is produced by electrolyzing the chlorine ions inside service water, the concentration of the chlorine ions inside service water differs by region. Therefore, there are cases where the concentration of the hypochlorous acid for sterilizing the washing nozzle cannot be ensured when ensuring the flow rate to remove the liquid waste and/or the solid waste adhered to the washing nozzle. In other words, although the concentration of the hypochlorous acid can be increased by reducing the flow rate of the water supplied to the electrolytic cell, on the other hand, the water force (the flow rate) to remove the liquid waste and/or the solid waste adhered to the washing nozzle is unfortunately insufficient.

[Citation List]

[Patent Literature]

[Patent Citation 1] JP 3487447

[Patent Citation 2] International Publication 95/32922 Pamphlet

SUMMARY OF INVENTION

Technical Problem

The invention was carried out based on consideration of the relevant problems; and it is an object to provide a sanitary washing apparatus in which the washing nozzle can be sterilized more efficiently or a user's sense of cleanliness regarding the washing nozzle can be improved.

Solution to Problem

The first invention is a sanitary washing apparatus including a nozzle having a water discharge port, the nozzle being configured to wash a human private part by squirting water from the water discharge port, a flow channel configured to supply the water to the nozzle, a sterilizing water supply unit provided partway through the flow channel, the sterilizing water supply unit being capable of supplying sterilizing water, and a control unit configured to execute a physical washing process of washing the nozzle using water and a sterilizing process of sterilizing the nozzle using the sterilizing water after the washing the human private part.

BRIEF DESCRIPTION OF DRAWINGS

[*Fig.* 1]

Figure 1:
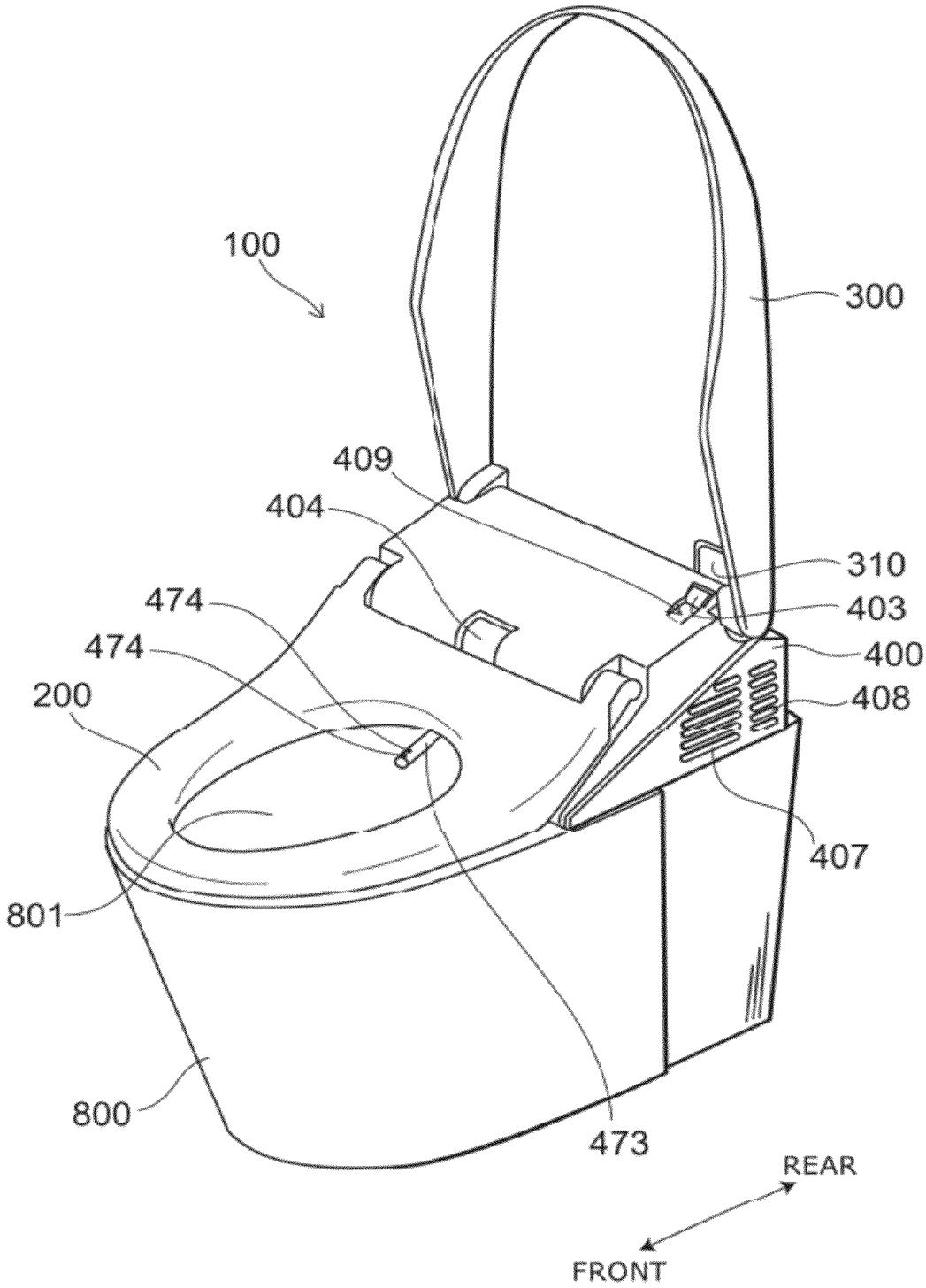

FIG. 1 is a schematic perspective view illustrating a toilet apparatus including a sanitary washing apparatus according to an embodiment of the invention.

[*Fig.* 2]

Figure 2:
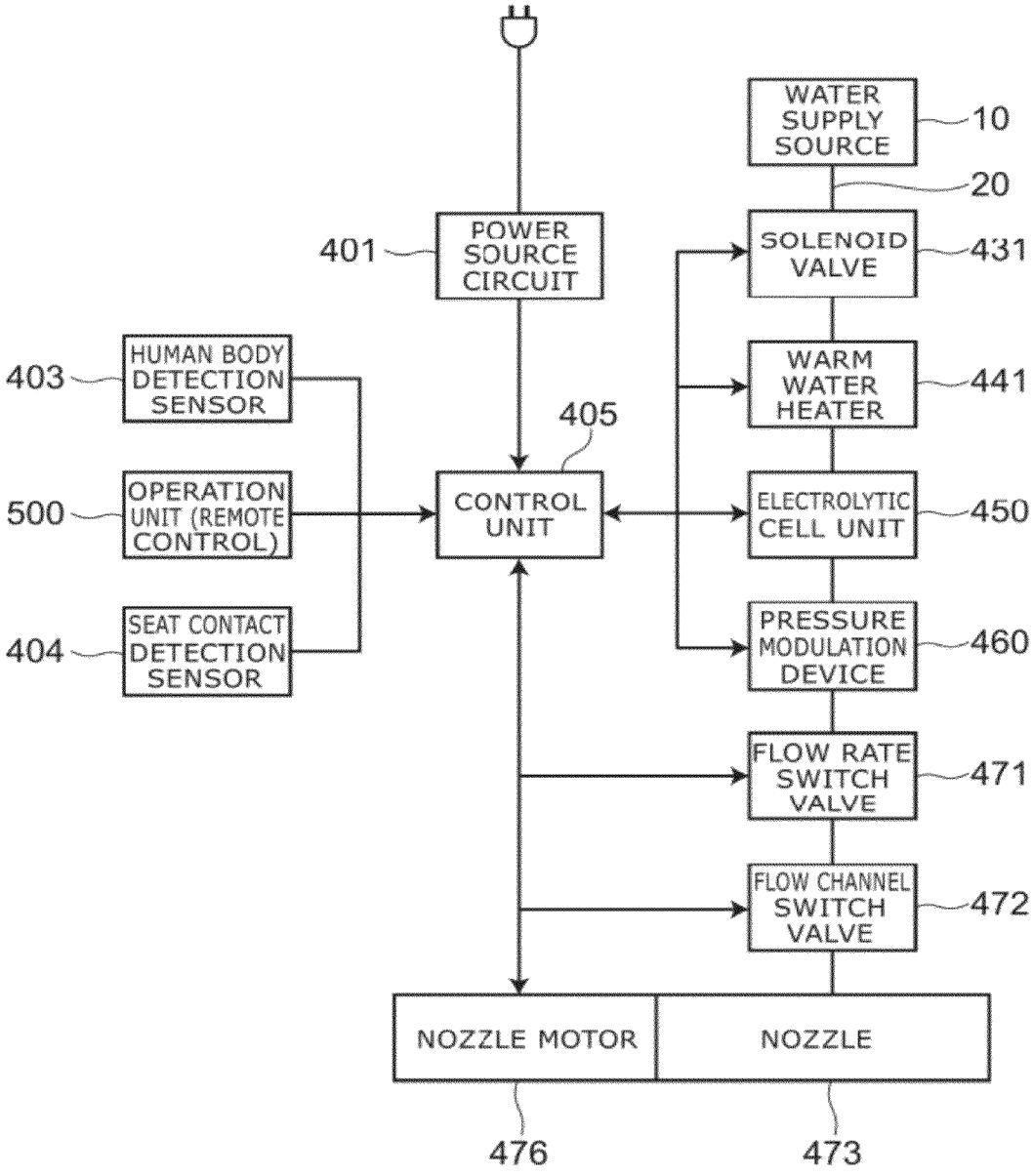

FIG. 2 is a block diagram illustrating the relevant components of the sanitary washing apparatus according to the embodiment.

[*Fig.* 3]

Figure 3:
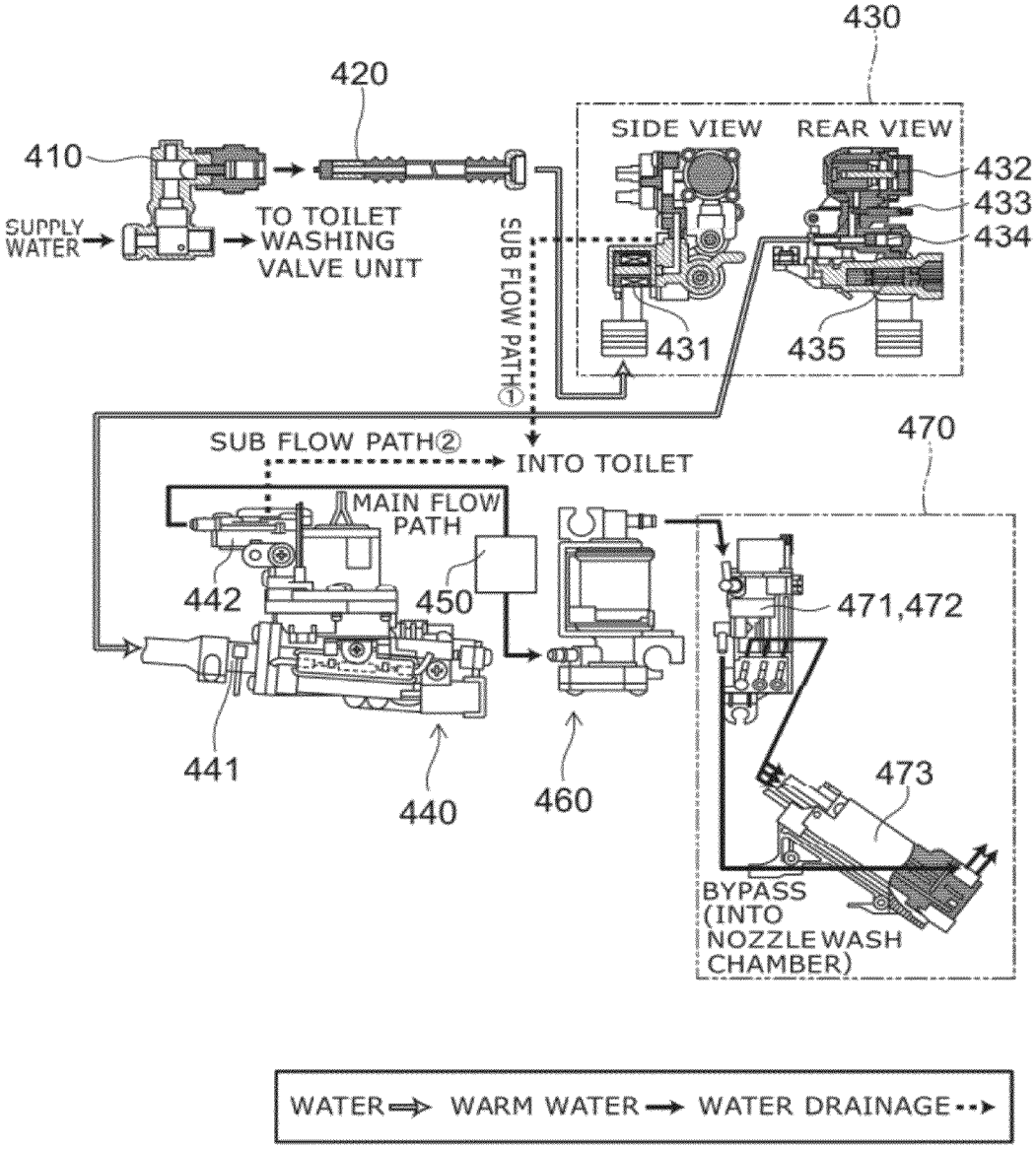

FIG. 3 is a block diagram illustrating a specific example of the relevant components of the water channel system of the sanitary washing apparatus according to the embodiment.

[*Fig.* 4]

Figure 4:
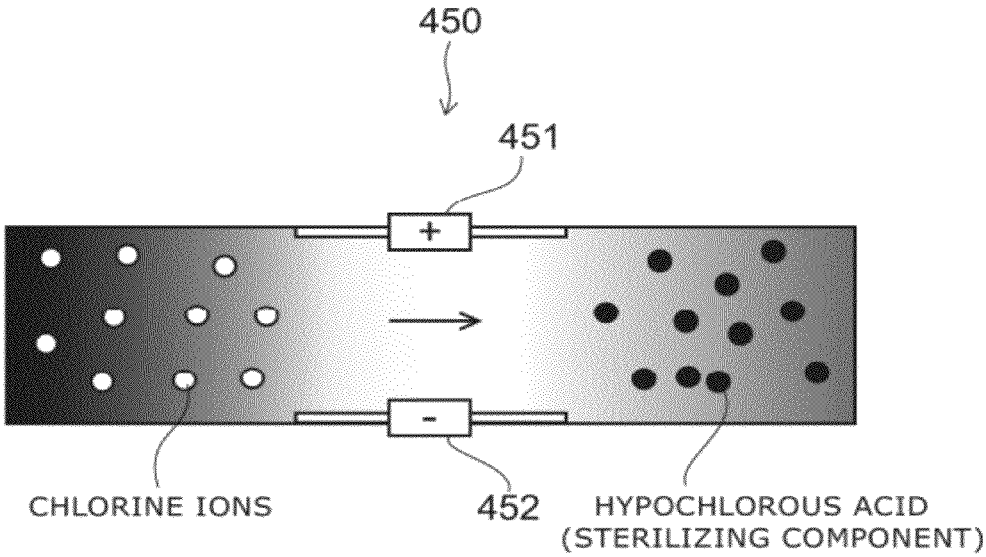

FIG. 4 is a schematic cross-sectional view illustrating a specific example of the electrolytic cell unit of the embodiment.

[*Fig.* 5]

Figure 5:
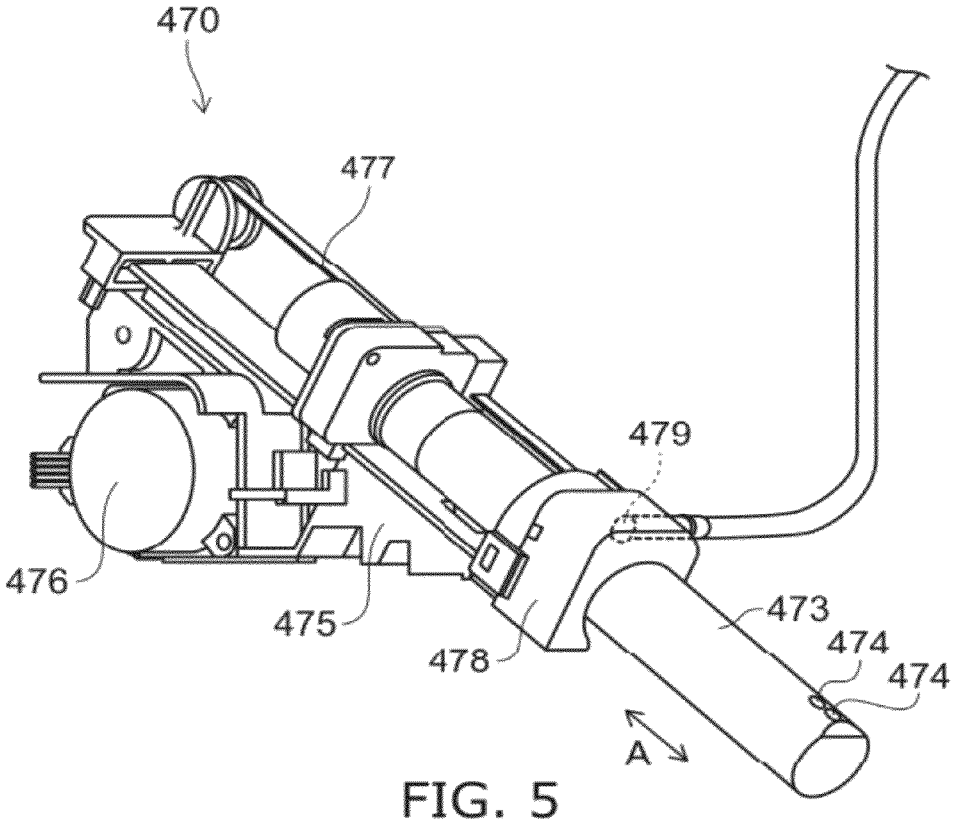

FIG. 5 is a schematic perspective view illustrating a specific example of the nozzle unit of the embodiment.

[*Fig.* 6]

Figure 6:
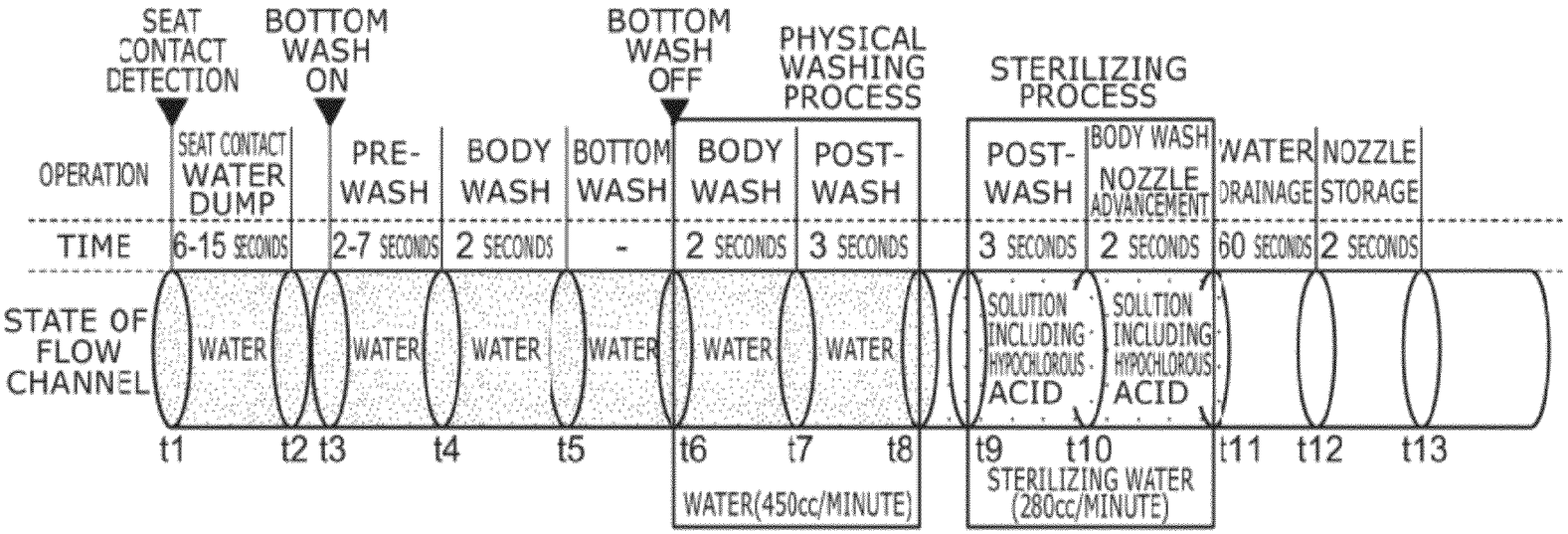

FIG. 6 is a conceptual schematic view illustrating the schematic of the operations and the state of the flow channel of the sanitary washing apparatus according to the embodiment.

[*Fig.* 7]

Figure 7:
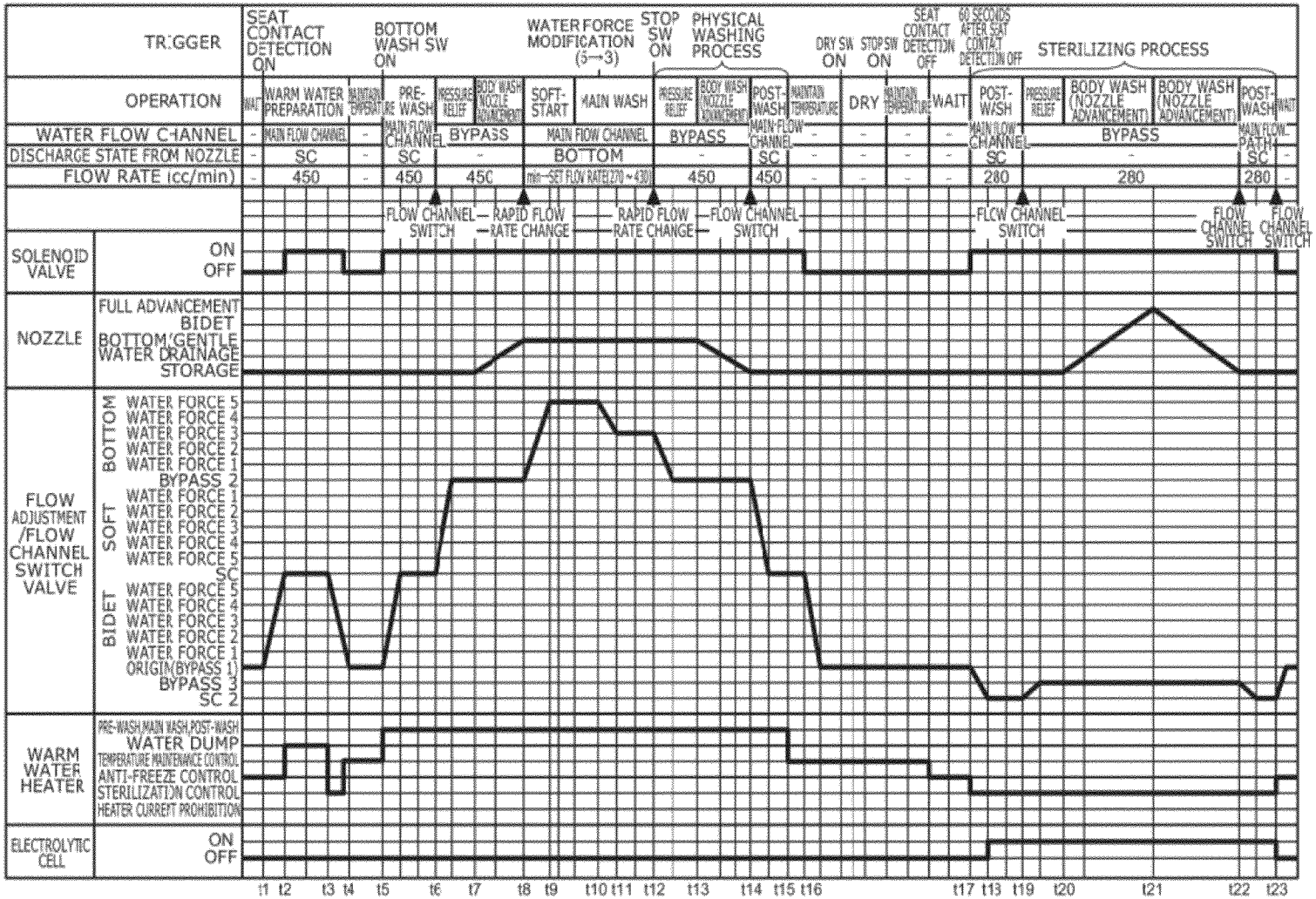

FIG. 7 is a timing chart illustrating a specific example of the operations of the sanitary washing apparatus according to the embodiment.

DESCRIPTION OF EMBODIMENTS

The first invention is a sanitary washing apparatus including a nozzle having a water discharge port, the nozzle being configured to wash a human private part by squirting water from the water discharge port, a flow channel configured to supply the water to the nozzle, a sterilizing water supply unit provided partway through the flow channel, the sterilizing water supply unit being capable of supplying sterilizing water, and a control unit configured to execute a physical washing process of washing the nozzle using water and a sterilizing process of sterilizing the nozzle using the sterilizing water after the washing the human private part.

According to this sanitary washing apparatus, the washing and the sterilizing of the nozzle is not performed at one condition; and the washing and the sterilizing of the nozzle can be performed by being separated into the physical washing process and the sterilizing process. Therefore, washing and sterilizing that are matched to the conditions of the respective processes can be performed. That is, the nozzle can be sterilized more efficiently. Thereby, the user's sense of cleanliness regarding the nozzle can be improved.

In other words, much of the dirt and/or the bacteria of the solid waste and the like of the flow channel and the surface of the nozzle is washed by being forcibly peeled and removed from the surface by the physical washing process. In particular, the solid waste which has a high oil and fat content becomes easier to peel by utilizing warm water as the wash water. Then, by the sterilizing process, it is possible to effectively bring the remaining bacteria into contact with the sterilizing water and sterilize the remaining bacteria without the remaining bacteria being hidden by the solid waste and the like. It is unnecessary to wastefully utilize the sterilizing water in the physical washing process because the sterilizing water from the sterilizing water supply unit is not utilized. In particular, in the case where the electrolytic cell is utilized as the sterilizing water supply unit, the drive time of the electrolytic cell affects the life of the electrolytic cell. Therefore, it is effective in that it is unnecessary to perform wasteful electrolysis.

The second invention is the sanitary washing apparatus of the first invention, wherein the sterilizing water supply unit is an electrolytic cell capable of producing the sterilizing water.

According to this sanitary washing apparatus, the electrolytic cell can produce the sterilizing water by a current provided between opposing electrodes. Therefore, it is easy to electrically control the timing of the production/supply of the sterilizing water. In particular, hypochlorous acid that is produced by the electrolysis of service water has an excellent ability to sterilize bacteria and has excellent safety because the hypochlorous acid that does not contribute to the sterilization returns to the original service water.

The third invention is the sanitary washing apparatus of the second invention, further including a heating unit provided in the flow channel upstream of the electrolytic cell, the heating unit being capable of heating the water, the control unit controlling the heating unit to cause a temperature of the water when executing the physical washing process to be different from a temperature of the sterilizing water when executing the sterilizing process.

According to this sanitary washing apparatus, the condition caused by the concentration of the sterilizing components of the sterilizing water can be caused to be different between the case where the sterilizing process is executed and the case where the physical washing process is executed. More specifically, the concentration of the sterilizing components of the sterilizing water can be increased further by further increasing the temperature of the sterilizing water. Conversely, the value of the current flowing between the electrodes can be reduced in the case where the temperature of the sterilizing water is reduced further. Thereby, the life of the electrolytic cell can be increased because the amount of scale adhering to the electrode surfaces can be reduced.

In the case where the sterilizing process is executed, the outer circumferential surface of the nozzle can be sterilized more efficiently by causing the sterilizing water to spread widely over the outer circumferential surface of the nozzle. In other words, the stronger water force is unnecessary in the case where the sterilizing process is executed. This is because the sterilizing process does not perform the sterilization by a physical effect such as the water force, etc., but performs the sterilization by the sterilizing components of the sterilizing water.

On the other hand, the stronger water force is necessary in the case where the physical washing process is executed. This is because the physical washing process rinses away and removes the liquid waste and/or the solid waste adhered to the nozzle by a physical effect such as the water force, etc.

Therefore, according to this sanitary washing apparatus, the nozzle can be sterilized more efficiently by causing the conditions caused by the concentration of the sterilizing components of the sterilizing water to be different. Thereby, the user's sense of cleanliness regarding the nozzle can be improved.

The fourth invention is the sanitary washing apparatus of the first invention, wherein the control unit causes a flow rate of the sterilizing water when executing the sterilizing process to be less than a flow rate of the water when executing the physical washing process.

According to this sanitary washing apparatus, the condition caused by the concentration of the sterilizing components of the sterilizing water can be caused to be different between the case where the sterilizing process is executed and the case where the physical washing process is executed. More specifically, the concentration of the sterilizing components of the sterilizing water can be increased further by further reducing the flow rate of the supplied water.

In the case where the sterilizing process is executed, the outer circumferential surface of the nozzle can be sterilized more efficiently by causing the sterilizing water to spread widely over the outer circumferential surface of the nozzle. In other words, the stronger water force is unnecessary in the case where the sterilizing process is executed. This is because the sterilizing process does not perform the sterilization by a physical effect such as the water force, etc., but performs the sterilization by the sterilizing components of the sterilizing water.

On the other hand, the stronger water force is necessary in the case where the physical washing process is executed. This is because the physical washing process rinses away and removes the liquid waste and/or the solid waste adhered to the nozzle by a physical effect such as the water force, etc.

Therefore, according to this sanitary washing apparatus, the nozzle can be sterilized more efficiently by causing the conditions caused by the concentration of the sterilizing components of the sterilizing water to be different. Thereby, the user's sense of cleanliness regarding the nozzle can be improved.

The fifth invention is the sanitary washing apparatus of the first invention, further including a drive unit configured to cause the nozzle to advance and retreat, the control unit controlling the drive unit to cause an advance/retreat speed of the nozzle when executing the sterilizing process to be slower than an advance/retreat speed of the nozzle when executing the physical washing process.

According to this sanitary washing apparatus, the nozzle can be sterilized carefully and more efficiently because the advance/retreat speed of the nozzle is slower than in the sterilizing process. Also, in the case where the nozzle is an expandable/contractible multistage nozzle, bacteria easily propagate at the portions of the joints between adjacent cylinder units. Therefore, the portions of the joints between the adjacent cylinder units can be sterilized carefully and more efficiently by the control unit causing the advance/retreat speed of the nozzle to be slower in the sterilizing process.

The sixth invention is the sanitary washing apparatus of the first invention, wherein the control unit executes the physical washing process and the sterilizing process as a series of operations while interposing a time interval between the physical washing process and the sterilizing process.

Although it is not always necessary to continuously perform the physical washing process and the sterilizing process according to this sanitary washing apparatus, the propagation of the bacteria can be suppressed in the case where the operations of the physical washing process and the sterilizing process are performed as a series of operations. That is, the nozzle can be sterilized more efficiently. Thereby, the user's sense of cleanliness regarding the nozzle can be improved.

Embodiments of the invention will now be described with reference to the drawings. Similar components in the drawings are marked with like reference numerals, and a detailed description is omitted as appropriate.

FIG. 1 is a schematic perspective view illustrating a toilet apparatus including a sanitary washing apparatus according to an embodiment of the invention.

FIG. 2 is a block diagram illustrating the relevant components of the sanitary washing apparatus according to the embodiment.

FIG. 2 simultaneously illustrates the relevant components of the water channel system and the electrical system.

The toilet apparatus illustrated in FIG. 1 includes a western-style sit-down toilet (called simply "toilet" for convenience of description hereinbelow) 800 and a sanitary washing apparatus 100 provided on the toilet 800. The sanitary washing apparatus 100 includes a casing 400, a toilet seat 200, and a toilet lid 300. The toilet seat 200 and the toilet lid 300 are pivotally supported openably and closeably with respect to the casing 400.

A private part wash functional unit and the like that realize the washing of a "bottom" and the like of a user sitting on the toilet seat 200 are built into the interior of the casing 400. Also, for example, a seat contact detection sensor 404 configured to detect the user sitting on the toilet seat 200 is provided in the casing 400. In the case where the seat contact detection sensor 404 detects the user sitting on the toilet seat 200, a washing nozzle (called simply "nozzle" for convenience of description hereinbelow) 473 can be caused to advance into a bowl 801 of the toilet 800 when the user operates, for example, an operation unit 500 such as a remote control. In the sanitary washing apparatus 100 illustrated in FIG. 1, the nozzle 473 is illustrated in the state of being advanced into the bowl 801

One or multiple water discharge ports 474 are provided in the tip portion of the nozzle 473. Then, the nozzle 473 can wash the "bottom" and the like of the user sitting on the toilet seat 200 by squirting water from the water discharge ports 474 provided in the tip portion. "Water" referred to in the specification of the application includes not only cold water but also heated warm water.

More specifically, the sanitary washing apparatus 100 according to the embodiment includes a flow channel 20 configured to guide water supplied from a water supply source 10 such as a service water line, a water storage tank, etc., to the water discharge ports 474 of the nozzle 473 as illustrated in FIG. 2. A solenoid valve 431 is provided on the upstream side of the flow channel 20. The solenoid valve 431 is an openable and closable solenoid valve that controls the supply of the water based on a command from a control unit 405 provided in the interior of the casing 400.

A warm water heater 441 is provided downstream of the solenoid valve 431. The warm water heater 441 heats the supplied water to become the prescribed warm water. The warm water temperature can be set by, for example, the user operating the operation unit 500.

An electrolytic cell unit (a sterilizing water supply unit) 450 capable of producing the sterilizing water is provided downstream of the warm water heater 441. The electrolytic cell unit 450 is elaborated later. Moreover, the electrolytic cell unit 450 may be provided not partway through the flow channel 20 but partway through a not-illustrated flow channel that branches from the water supply source 10 for the electrolytic cell unit 450.

A pressure modulation device 460 is provided downstream of the electrolytic cell unit 450. The pressure modulation device 460 can provide a pulsatory motion to the flow of the water inside the flow channel 20 and can provide a pulsatory motion to the water discharged from the water discharge ports 474 of the nozzle 473.

A flow rate switch valve 471, which adjusts the water force (the flow rate), and a flow channel switch valve 472, which performs the opening and closing and/or the switching of the supply water to the nozzle 473 and/or a nozzle wash chamber 478 (referring to FIG. 5), are provided downstream of the pressure modulation device 460. As in a specific example described below in regard to FIG. 3, the flow rate switch valve 471 and the flow channel switch valve 472 may be provided as one unit. Continuing, the nozzle 473 is provided downstream of the flow rate switch valve 471 and the flow channel switch valve 472.

The nozzle 473 can advance and retreat inside the bowl 801 of the toilet 800 by receiving a drive force from a nozzle motor (a drive unit) 476. That is, the nozzle motor 476 can cause the nozzle 473 to advance and retreat based on a command from the control unit 405.

Then, the control unit 405 is supplied with electrical power from a power source circuit 401 and can control the operations of the solenoid valve 431, the warm water heater 441, the electrolytic cell unit 450, the pressure modulation device 460, the flow rate switch valve 471, the flow channel switch valve 472, and the nozzle motor 476 based on signals from a human body detection sensor 403, the seat contact detection sensor 404, the operation unit 500, etc.

As illustrated in FIG. 1, the human body detection sensor 403 is provided to be sunk into a recessed portion 409 made in the upper face of the casing 400 and can detect the user (the human body) approaching the toilet seat 200. Also, a transmissive window 310 is provided in a rear portion of the toilet lid 300. Therefore, the human body detection sensor 403 can detect the existence of the user via the transmissive window 310 in the state in which the toilet lid 300 is closed. Then, for example, when the human body detection sensor 403 detects the user, the control unit 405 can automatically open the toilet lid 300 based on the detection result of the human body detection sensor 403.

Various mechanisms such as a "warm air drying function" that dries the "bottom" and the like of the user sitting on the toilet seat 200 by blowing warm air toward the "bottom" and the like of the user, a "deodorizing unit," a "room heating unit,", etc., may be appropriately provided in the casing 400. In such a case, an exhaust port 407 from the deodorizing unit and an outlet 408 from the room heating unit may be appropriately provided in the side face of the casing 400. However, in the invention, it is not always necessary to provide sanitary washing functional units and other additional function units.

FIG. 3 is a block diagram illustrating a specific example of the relevant components of the water channel system of the sanitary washing apparatus according to the embodiment.

FIG. 4 is a schematic cross-sectional view illustrating a specific example of the electrolytic cell unit of the embodiment.

FIG. 5 is a schematic perspective view illustrating a specific example of the nozzle unit of the embodiment.

First, as illustrated in FIG. 3, the water supplied from the water supply source 10 is guided into a metal branch fitting 410. The water guided into the metal branch fitting 410 is distributed into a coupling hose 420 and a not-illustrated valve unit for toilet washing. However, the toilet apparatus including the sanitary washing apparatus 100 according to the embodiment is not limited to a so-called "direct service water line pressure type" and may be a so-called "low tank type." Therefore, in the case where the toilet apparatus is the "low tank type," the water guided into the metal branch fitting 410 is guided into a not-illustrated low tank instead of the valve unit for the toilet washing.

Continuing, the water supplied to the coupling hose 420 is guided into a valve unit 430. The valve unit 430 includes the solenoid valve 431, a pressure adjustment valve 432, an incoming water thermistor 433, a safety valve 434, and a water drain cock 435. The pressure adjustment valve 432 has the role of adjusting the water supply pressure to a prescribed pressure range in the case where the water supply pressure is high. The incoming water thermistor 433 detects the temperature of the water guided into a heat exchanger unit 440. The safety valve 434 opens when the pressure of the flow channel 20 becomes high to discharge the water into the bowl 801 of the toilet 800. By providing the safety valve 434, the occurrence of water leakage in the interior of the sanitary washing apparatus 100 can be prevented even in the case where the pressure of the flow channel 20 increases on the secondary side (the downstream side) of the pressure adjustment valve 432 due to, for example, failure of the pressure adjustment valve 432, etc. Further, the water drain cock 435 can be used to discharge the water inside the flow channel 20 when there is a risk that the water inside the flow channel 20 may freeze, etc. The solenoid valve 431 is described above.

Continuing, the water supplied to the valve unit 430 is guided into the heat exchanger unit 440. The heat exchanger unit (the heating unit) 440 includes the warm water heater 441 and a vacuum breaker 442. The vacuum breaker 442 prevents, for example, liquid waste from flowing backward from the nozzle 473 in the case where a negative pressure occurs in the valve unit 430, etc. Alternatively, the vacuum breaker 442 may promote water drainage of the flow channel 20 between the heat exchanger unit 440 and a nozzle unit 470 by intaking air from the outside when the water drainage of the flow channel 20 is performed. Then, the water from the vacuum breaker 442 is discharged into the bowl 801 of the toilet 800.

Continuing, the water supplied to the heat exchanger unit 440 and heated to the prescribed temperature is guided into the electrolytic cell unit 450. The electrolytic cell unit 450 can produce the sterilizing water as described above in regard to FIG. 1 and FIG. 2. The electrolytic cell unit 450 of the embodiment will now be described with reference to the drawings.

As illustrated in FIG. 4, the electrolytic cell unit 450 includes an anode plate 451 and a cathode plate 452 in the interior of the electrolytic cell unit 450 and can electrolyze the service water flowing through the interior by controlling the flow of the current from the control unit 405. Here, the service water includes chlorine ions. These chlorine ions are included in water sources (e.g., groundwater, the water of dams, and the water of rivers and the like) as common salt (NaCl) and calcium chloride ($CaCl_2$). Therefore, hypochlorous acid is produced by electrolyzing the chlorine ions. As a result, the water electrolyzed in the electrolytic cell unit 450 changes into a liquid including hypochlorous acid.

The hypochlorous acid functions as a sterilizing component; and the solution including the hypochlorous acid, i.e., the sterilizing water, can sterilize by efficiently removing or decomposing dirt due to ammonia and the like. In the specification of the application herein, "sterilizing water" refers to a solution that includes more sterilizing components such as hypochlorous acid and the like than does service water (also referred to as simply "water").

Thus, the service water supplied from the heat exchanger unit 440 becomes a solution including hypochlorous acid by being electrolyzed in the electrolytic cell unit 450 and is guided into the nozzle unit 470 via the pressure modulation device 460. As illustrated in FIG. 3, the nozzle unit 470 includes the flow rate switch valve 471, the flow channel switch valve 472, and the nozzle 473. The flow channel switch valve 472 can guide the sterilizing water supplied from the electrolytic cell unit 450 via the pressure modulation device 460 to the water discharge ports 474 of the nozzle 473 or the nozzle wash chamber 478 (referring to FIG. 5). The nozzle unit 470 will now be described with reference to the drawings.

As illustrated in FIG. 5, the nozzle unit 470 of the embodiment includes a mount 475 as a base, the nozzle 473 supported by the mount 475, and the nozzle motor 476 configured to move the nozzle 473. As in arrow A illustrated in FIG. 5, the nozzle 473 is provided slidably with respect to the mount 475 by the drive force transmitted from the nozzle motor 476 via a transmission member 477 such as a belt, etc. In other words, the nozzle 473 can move straight in the axial direction (the advance/retreat direction) of the nozzle 473 itself. Then, the nozzle 473 can move advanceably and retreatably with respect to the casing 400 and the mount 475.

The nozzle wash chamber 478 is provided in the nozzle unit 470 of the embodiment. The nozzle wash chamber 478 is fixed with respect to the mount 475 and can sterilize or wash the outer circumferential surface (the body) of the nozzle 473 by squirting sterilizing water or water from a water discharge unit 479 provided in the interior of the nozzle wash chamber 478. In other words, in the case where the control unit 405 produces the sterilizing water by providing the current to the anode plate 451 and the cathode plate 452 of the electrolytic cell unit 450, the body of the nozzle 473 is sterilized by the sterilizing water squirted from the water discharge unit 479. On the other hand, in the case where the control unit 405 does not provide the current to the anode plate 451 and the cathode plate 452 of the electrolytic cell unit 450, the body of the nozzle 473 is physically washed by the water squirted from the water discharge unit 479. Thus, the sanitary washing apparatus 100 according to the embodiment can execute the sterilizing process to sterilize the nozzle 473 using sterilizing water and the physical washing process to wash the nozzle 473 using water.

More specifically, the portion of the water discharge ports 474 of the nozzle 473 is substantially contained inside the nozzle wash chamber 478 in the state in which the nozzle 473 is stored in the casing 400. Therefore, the nozzle wash chamber 478 can sterilize or wash the portion of the water discharge ports 474 of the nozzle 473 in the stored state by squirting the sterilizing water or the water from the water discharge unit 479 provided in the interior of the nozzle wash chamber 478. Also, the nozzle wash chamber 478 can sterilize or wash not only the portion of the water discharge ports 474 but also the outer circumferential surface of other portions by squirting the water or the sterilizing water from the water discharge unit 479 when the nozzle 473 advances and retreats.

The nozzle 473 of the embodiment can sterilize or wash the portion of the water discharge ports 474 by discharging the sterilizing water or the water from the water discharge ports 474 of the nozzle 473 itself in the state in which the nozzle 473 is stored in the casing 400. Further, the sterilizing water or the water discharged from the water discharge ports 474 of the nozzle 473 comes into contact with the portion of the water discharge ports 474 by being reflected by the inner wall of the nozzle wash chamber 478 because the portion of the water discharge ports 474 of the nozzle 473 is substantially contained inside the nozzle wash chamber 478 in the state in which the nozzle 473 is stored in the casing 400. Therefore, the portion of the water discharge ports 474 of the nozzle 473 is sterilized or washed also by the sterilizing water or the water reflected by the inner wall of the nozzle wash chamber 478.

Here, it is more favorable for the concentration of the hypochlorous acid produced in the electrolytic cell unit 450 to be higher to efficiently sterilize the nozzle 473. By further increasing the concentration of the hypochlorous acid produced in the electrolytic cell unit 450, the user's sense of cleanliness regarding the nozzle 473 can be improved. At this time, the concentration of the hypochlorous acid produced in the electrolytic cell unit 450 can be increased further by further reducing the flow rate of the water supplied to the electrolytic cell unit 450.

However, in the case where the concentration of the hypochlorous acid produced in the electrolytic cell unit 450 is increased further to efficiently sterilize the nozzle 473, there are cases where the water force (the flow rate) of the physical washing process is insufficient to wash the nozzle 473 using the water. In other words, although the concentration of the hypochlorous acid can be increased by reducing the flow rate of the water supplied to the electrolytic cell unit 450, on the other hand, there are cases where the flow rate of the physical washing process is insufficient to remove the liquid waste and/or the solid waste adhered to the nozzle 473.

Conversely, as described above, the sanitary washing apparatus 100 according to the embodiment can execute the sterilizing process to sterilize the nozzle 473 using the sterilizing water and the physical washing process to wash the nozzle 473 using the water. Then, the sanitary washing apparatus 100 can cause the condition caused by the concentration of the hypochlorous acid to be different between the case where the sterilizing process is executed and the case where the physical washing process is executed. More specifically, the sanitary washing apparatus 100 can cause the temperature of the sterilizing water when executing the sterilizing process to be different from the temperature of the water when executing the physical washing process. Alternatively, the sanitary washing apparatus 100 can cause the water amount supplied to the electrolytic cell unit 450 when executing the sterilizing process to be different from the water amount supplied to the electrolytic cell unit 450 when executing the physical washing process. Alternatively, the sanitary washing apparatus 100 can cause the advance/retreat speed of the nozzle 473 when executing the sterilizing process to be different from the advance/retreat speed of the nozzle 473 when executing the physical washing process.

Accordingly, the concentration of the hypochlorous acid can be caused to be different between the case where the sterilizing process is executed and the case where the physical washing process is executed; and the nozzle 473 can be efficiently sterilized. Also, the user's sense of cleanliness regarding the nozzle 473 can be improved by further increasing the concentration of the hypochlorous acid produced in the electrolytic cell unit 450. These operations will now be described with reference to the drawings.

Although the case where the electrolytic cell unit 450 produces a solution including hypochlorous acid as the sterilizing water is illustrated as an example in the description regarding FIG. 3 to FIG. 5, the sterilizing water produced in the electrolytic cell unit 450 is not limited only to this case. The sterilizing water produced in the electrolytic cell unit 450 may be, for example, a solution including metal ions such as silver ions, copper ions, etc. Alternatively, the sterilizing water produced in the electrolytic cell unit 450 may be a solution including electrolytic chlorine, ozone, etc. Alternatively, the sterilizing water produced in the electrolytic cell unit 450 may be acidic water or alkaline water. These cases are included in the scope of the invention to the extent that the features of the invention are included. For convenience of description hereinbelow, the case where the sterilizing water is a solution including hypochlorous acid is described as an example.

The electrolytic cell unit 450 may be provided not partway through the flow channel 20 but partway through a not-illustrated flow channel that branches from the water supply source 10 for the electrolytic cell unit 450. In such a case, the flow channel may be formed from the electrolytic cell unit 450 to reach the water discharge unit that directly discharges onto the body portion of the nozzle 473. By such a formation, it is possible to effectively discharge the sterilizing water without a delay to match the sterilizing timing because the electrolyte solution can be stored. It is sufficient for the sterilizing water supply unit to be capable of supplying the sterilizing water without being limited to having an electrolytic cell.

FIG. 6 is a conceptual schematic view illustrating the schematic of the operations and the state of the flow channel of the sanitary washing apparatus according to the embodiment.

First, when the seat contact detection sensor 404 detects the user seated on the toilet seat 200 (timing t1), the control unit 405 opens the solenoid valve 431 and executes a "water dump" (timing t1 to t2). Thereby, the cold water inside the flow channel 20 is drained; and preparation for the warm water is performed. At this time, the control unit 405 does not provide the current to the electrolytic cell unit 450; and the sterilizing water is not produced. The implementation time of the "water dump" is, for example, about 6 to 15 seconds.

Continuing, when the user presses a not-illustrated "bottom wash switch" provided in the operation unit 500 (timing t3), the control unit 405 executes a pre-wash (timing t3 to t4). More specifically, the control unit 405 discharges the water from all of the multiple water discharge ports 474 to wash the water discharge ports 474 by controlling the flow rate switch valve 471 and the flow channel switch valve 472. At this time as well, the control unit 405 does not provide the current to the electrolytic cell unit 450; and the sterilizing water is not produced. Therefore, the multiple water discharge ports 474 are physically washed by the water that the water discharge ports 474 themselves discharge (including the water reflected by the inner wall of the nozzle wash chamber 478). The implementation time of the pre-wash is, for example, about 2 to 7 seconds.

Then, the control unit 405 causes the nozzle 473 to advance into the bowl 801 while squirting water from the water discharge unit 479 provided in the nozzle wash chamber 478 by controlling the flow rate switch valve 471 and the flow channel switch valve 472. Therefore, the body of the nozzle 473 is washed using the water squirted from the water discharge unit 479 (timing t4 to t5). At this time as well, the control unit 405 does not provide the current to the electrolytic cell unit 450; and the sterilizing water is not produced. Therefore, the body of the nozzle 473 is physically washed by the water squirted from the water discharge unit 479. The implementation time of the body wash is, for example, about 2 seconds.

Continuing, the control unit 405 washes the "bottom" of the user seated on the toilet seat 200 by squirting the water from the water discharge ports 474 for the "bottom wash" by controlling the flow rate switch valve 471 and the flow channel switch valve 472 (timing t5 to t6). At this time, the control unit 405 does not provide the current to the electrolytic cell unit 450; and the sterilizing water is not produced. Therefore, the sterilizing water is not squirted onto the private parts of the user.

Then, when the user uses the operation unit 500 to press a not-illustrated "stop switch" (timing t6), the control unit 405 stores the nozzle 473 inside the casing 400 while squirting water from the water discharge unit 479 provided in the nozzle wash chamber 478 by controlling the flow rate switch valve 471 and the flow channel switch valve 472 (timing t6 to t7). The operation of the body wash at this time is similar to the operation of the body wash of timing t4 to t5.

Continuing, the control unit 405 discharges water from all of the multiple water discharge ports 474 to execute a post-wash of the water discharge ports 474 by controlling the flow rate switch valve 471 and the flow channel switch valve 472 in the state in which the nozzle 473 is stored in the casing 400 (timing t7 to t8). The operation of the post-wash is similar to the operation of the pre-wash of timing t3 to t4; and the multiple water discharge ports 474 are physically washed by the water that the water discharge ports 474 themselves discharge (including the water reflected by the inner wall of the nozzle wash chamber 478).

Thus, the sanitary washing apparatus 100 according to the embodiment can physically perform the body wash and the post-wash of the nozzle 473 using the supplied water, that is, can execute the physical washing process (timing t6 to t8). The water amount when executing the physical washing process is, for example, about 450 cc/minute. Thereby, the liquid waste and/or the solid waste adhered to the nozzle 473 can be rinsed away and removed. At this time, the solid waste which has a high oil and fat content can be easily peeled from the surface of the nozzle 473 by utilizing warm water as the water utilized in the physical washing process.

Continuing, the control unit 405 provides a current to the electrolytic cell unit 450; and the sterilizing water is produced. Then, the control unit 405 discharges the sterilizing water from all of the multiple water discharge ports 474 to execute the post-wash of the water discharge ports 474 by controlling the flow rate switch valve 471 and the flow channel switch valve 472 (timing t9 to t10). At this time, the multiple water discharge ports 474 are sterilized by the sterilizing water that the water discharge ports 474 themselves discharge (including the sterilizing water reflected by the inner wall of the nozzle wash chamber 478) because the sterilizing water is discharged from the water discharge ports 474. The implementation time of the post-wash is, for example, about 3 seconds.

Then, the control unit 405 causes the nozzle 473 to advance into the bowl 801 while squirting the sterilizing water from the water discharge unit 479 provided in the nozzle wash chamber 478 by controlling the flow rate switch valve 471 and the flow channel switch valve 472. Therefore, the body of the nozzle 473 is sterilized using the sterilizing water squirted from the water discharge unit 479 (timing t10 to t11). That is, the body of the nozzle 473 is sterilized by the sterilizing water squirted from the water discharge unit 479 because the control unit 405 provides the current to the electrolytic cell unit 450 and the sterilizing water is produced. The implementation time of the body wash is, for example, about 2 seconds.

Thus, the sanitary washing apparatus 100 according to the embodiment can perform the post-wash and the body wash of the nozzle 473 using the sterilizing water produced in the electrolytic cell unit 450, that is, can execute the sterilizing process (timing t9 to t11). The water amount when executing the sterilizing process is, for example, about 280 cc/minute. That is, the water amount supplied when executing the sterilizing process (timing t9 to t11) is less than the water amount supplied when executing the physical washing process (timing t6 to t8). Therefore, the concentration of the hypochlorous acid of the sterilizing water produced in the electrolytic cell unit 450 can be increased further. Even in such a case, in the sanitary washing apparatus 100 according to the embodiment, there is little risk of the flow rate of the physical washing process being insufficient because the physical washing process can be executed using a water amount higher than the water amount of the sterilizing process.

In other words, in the case where the sterilizing process is executed, the outer circumferential surface (the body) of the nozzle 473 can be sterilized by causing the sterilizing water to spread widely over the outer circumferential surface of the nozzle 473. In other words, the stronger water force is unnecessary in the case where the sterilizing process is executed. This is because the sterilizing process of the embodiment does not perform the sterilization by a physical effect such as the water force, etc., but performs the sterilization by sterilizing components such as hypochlorous acid, etc.

On the other hand, the stronger water force is necessary in the case where the physical washing process is executed. This is because the physical washing process of the embodiment rinses away and removes the liquid waste and/or the solid waste adhered to the nozzle 473 by a physical effect such as the water force, etc. Therefore, the sanitary washing apparatus 100 according to the embodiment can cause the condition caused by the concentration of the hypochlorous acid (the water amount supplied in the operation relating to FIG. 6) to be different between the case where the sterilizing process is executed and the case where the physical washing process is executed. Thereby, the sanitary washing apparatus 100 according to the embodiment can efficiently sterilize the nozzle 473. Also, the user's sense of cleanliness regarding the nozzle 473 can be improved by further increasing the concentration of the hypochlorous acid produced in the electrolytic cell unit 450.

Continuing, the control unit 405 performs a "water drainage" (timing t11 to t12). The implementation time of the "water drainage" is, for example, about 60 seconds. Continuing, the control unit 405 stores the nozzle 473 inside the casing 400 by controlling the operation of the nozzle motor 476. The time for the nozzle storage is, for example, about 2 seconds.

Although a time interval (timing t8 to t9) exists between the physical washing process (timing t6 to t8) and the sterilizing process (timing t9 to t11) in the operation of the sanitary washing apparatus 100 illustrated in FIG. 6, this time interval may not exist. In other words, the physical washing process and the sterilizing process may be performed continuously or may be performed with a constant interval. That is, in the specification of the application, the operation performed with the time interval interposed between the physical washing process and the sterilizing process is included in the scope of the continuous operation of the aspect in which the physical washing process and the sterilizing process are performed as a series of operations.

Although this constant interval is specifically described in the operation description recited below, it is desirable for this constant interval to be an interval from the physical washing process after the bottom wash until about several tens of seconds after the user rises (seat contact detection OFF). If the interval is too long, there is a risk that the bacteria remaining on the surface may propagate and cannot be sterilized without increasing the sterilization time.

FIG. 7 is a timing chart illustrating a specific example of the operations of the sanitary washing apparatus according to the embodiment.

First, when the seat contact detection sensor 404 detects the user seated on the toilet seat 200 (timing t1), the control unit 405 switches the flow rate switch valve 471 and the flow channel switch valve 472 from the "origin" to "SC (self-cleaning)" and makes it possible to discharge from all of the water discharge ports 474 for the "bottom wash" and the "bidet wash." The flow rate (the water amount) at this time is, for example, about 450 cc/minute.

Continuing, when the switching of the flow rate switch valve 471 and the flow channel switch valve 472 is completed (timing t2), the control unit 405 opens the solenoid valve 431 and sets the warm water heater 441 to a "water dump mode." Thereby, the cold water inside the flow channel 20 is drained; and the preparation of the warm water is performed. Then, after performing a setting modification of the warm water heater 441 from the "water dump mode" to a "sterilization control mode," the control unit 405 closes the solenoid valve 431 (timing t3 to t4). This is because excess heat is generated even after the warm water heater 441 is set to "OFF." In other words, the solenoid valve 431 is closed for so-called "post-heating prevention" after the control unit 405 performs the setting modification of the warm water heater 441.

Then, when the user presses a not-illustrated "bottom wash switch" provided in the operation unit 500 (timing t5), the control unit 405 switches the flow rate switch valve 471 and the flow channel switch valve 472 from the "origin" to "SC," opens the solenoid valve 431, and sets the warm water heater 441 to the "pre-wash mode, the main wash mode, and the post-wash mode." Thereby, the pre-wash of the nozzle 473 is performed. The temperature of the warm water heater 441 at this time, i.e., the set temperature of the warm water heater 441 of the "pre-wash mode, the main wash mode, and the post-wash mode," is different from the set temperature of the warm water heater 441 of the sterilizing process described below. This is elaborated later. Continuing, the control unit 405 switches the flow rate switch valve 471 and the flow channel switch valve 472 from "SC" to "bypass 2" and makes it possible to squirt the water from the water discharge unit 479 provided in the nozzle wash chamber 478 (timing t6).

Continuing, the control unit 405 causes the nozzle 473 stored in the casing 400 to advance to the position of the "bottom wash" (timing t7 to t8). At this time, the body of the nozzle 473 is washed by the water squirted from the water discharge unit 479 because the solenoid valve 431 is opened by the control unit 405. Also, the movement speed (the advancement speed) of the nozzle 473 at this time is faster than the movement speed (the advance/retreat speed) of the sterilizing process described below to respond to the demand of the user of wanting to wash the "bottom" sooner.

Then, the control unit 405 switches the flow rate switch valve 471 and the flow channel switch valve 472 from "bypass 2" to "bottom water force 5" and starts the main wash (the bottom wash) (timing t8 to t10). For example, in the case where the user uses the operation unit 500 to perform a setting modification of the water force of the "bottom wash" from "water force 5" to "water force 3," the control unit 405 switches the flow rate switch valve 471 and the flow channel switch valve 472 from "bottom water force 5" to "bottom water force 3" (timing t10 to t11). Then, the control unit 405 continues the main wash at "water force 3" (timing t11 to t12).

In the operations of timing t1 to t12, the control unit 405 does not provide the current to the electrolytic cell unit 450; and the sterilizing water is not produced. Therefore, in the pre-wash (timing t5 to t6) and the body wash (timing t7 to t8), the nozzle 473 is physically washed using the water. Further, in the "bottom wash" (timing t8 to t12), the "bottom" of the user seated on the toilet seat 200 is washed by the water squirted from the water discharge ports 474 of the nozzle 473.

When the user uses the operation unit 500 to press a not-illustrated "stop switch," the control unit 405 switches the flow rate switch valve 471 and the flow channel switch valve 472 from "bottom water force 3" to "bypass 2" and makes it possible to squirt the water from the water discharge unit 479 provided in the nozzle wash chamber 478 (timing t12). Continuing, the control unit 405 stores the nozzle 473, which had advanced to the position of the "bottom wash," in the casing 400 (timing t13 to t14). At this time, the body of the nozzle 473 is physically washed by the water squirted from the water discharge unit 479 because the solenoid valve 431 is opened by the control unit 405 and the control unit 405 does not provide the current to the electrolytic cell unit 450. The movement speed (the retreat speed) of the nozzle 473 at this time is faster than the movement speed (the advance/retreat speed) of the sterilizing process described below to prevent solid waste from adhering during the storage (the retreat) of the nozzle 473.

Continuing, in the state in which the nozzle 473 is stored in the casing 400, the control unit 405 switches the flow rate switch valve 471 and the flow channel switch valve 472 from "bypass 2" to "SC" and performs the post-wash by discharging from all of the water discharge ports 474 for the "bottom wash" and the "bidet wash" (timing t14 to t15). At this time as well, the portion of the water discharge ports 474 of the nozzle 473 is physically washed by the water because the solenoid valve 431 is opened by the control unit 405 and the control unit 405 does not provide the current to the electrolytic cell unit 450.

Thus, the sanitary washing apparatus 100 according to the embodiment can physically perform the body wash and the post-wash of the nozzle 473 using the supplied water, that is, can execute the physical washing process (timing t12 to t15). The water amount when executing the physical washing process is, for example, about 450 cc/minute. Thereby, the liquid waste and/or the solid waste adhered to the nozzle 473 can be rinsed away and removed.

Continuing, the control unit 405 closes the solenoid valve 431 and switches the flow rate switch valve 471 and the flow channel switch valve 472 from "SC" to the "origin" (timing t16). Continuing, when a prescribed amount of time (here, 60 seconds) has elapsed after the user appropriately performs the "bottom dry" and rises from the toilet seat 200, the control unit 405 switches the flow rate switch valve 471 and the flow channel switch valve 472 from the "origin" to "SC2" and makes it possible to discharge from all of the water discharge ports 474 for the "bottom wash" and the "bidet wash" (timing t17). Also, the control unit 405 opens the solenoid valve 431 and sets the warm water heater 441 to the "sterilization control mode" (timing t17). Further, the control unit 405 starts to provide the current to the electrolytic cell unit 450; and the production of the sterilizing water is started (timing t18). Thereby, the post-wash of the nozzle 473 using the sterilizing water produced in the electrolytic cell unit 450 is performed.

The flow rate (the water amount) at this time is, for example, about 280 cc/minute. That is, the flow rate at this time is less than the flow rate of the physical washing process (e.g., about 450 cc/minute). Therefore, the concentration of the hypochlorous acid of the sterilizing water produced in the electrolytic cell unit 450 can be increased further. Further, the control unit 405 sets the warm water heater 441 to the "sterilization control mode" (timing t17). The temperature of the warm water heater 441 at this time, i.e., the set temperature of the warm water heater 441 of the "sterilization control mode," is different from the set temperature of the warm water heater 441 of the physical washing process, i.e., the set temperature of the warm water heater 441 of the "pre-wash mode, the main wash mode, and the post-wash mode."

In the case where the set temperature of the warm water heater 441 of the "sterilization control mode" is higher than the set temperature of the warm water heater 441 of the physical washing process, the concentration of the hypochlorous acid of the sterilizing water produced in the electrolytic cell unit 450 can be increased further. Therefore, in such a case, the sterilizing power of the sterilizing water can be increased; and the nozzle 473 can be efficiently sterilized.

On the other hand, in the case where the set temperature of the warm water heater 441 of the "sterilization control mode" is lower than the set temperature of the warm water heater 441 of the physical washing process, evaporation or volatilization of the sterilizing water adhered to the surface of the nozzle 473 can be suppressed. Therefore, in such a case, the sterilization effect of the sterilizing water can be sustained longer.

Moreover, the value of the current flowing between the anode plate 451 and the cathode plate 452 can be kept lower than in the case that is higher than the set temperature. Therefore, the occurrence of the scale on the surfaces of the anode plate 451 and the cathode plate 452 can be suppressed; and the life of the electrolytic cell unit 450 can be increased. Specifically, it is sufficient to electrolyze while stopping the current to the warm water heater 441 or reducing the amount of the current to the warm water heater 441.

Continuing, the control unit 405 switches the flow rate switch valve 471 and the flow channel switch valve 472 from "SC2" to "bypass 3" and makes it possible to squirt the sterilizing water from the water discharge unit 479 provided in the nozzle wash chamber 478 (timing t19). Continuing, the control unit 405 causes the nozzle 473 stored in the casing 400 to advance to the position of "full advancement" (timing t20 to t21). At this time, the body of the nozzle 473 is sterilized by the sterilizing water squirted from the water discharge unit 479 because the solenoid valve 431 is opened by the control unit 405 and the control unit 405 is providing the current to the electrolytic cell unit 450. Continuing, the control unit 405 stores the nozzle 473, which had advanced to the position of "full advancement," in the casing 400 (timing t21 to t22). At this time as well, the body of the nozzle 473 is sterilized by the sterilizing water squirted from the water discharge unit 479 because the solenoid valve 431 is opened by the control unit 405 and the control unit 405 provides the current to the electrolytic cell unit 450.

Here, the movement speed (the advance/retreat speed) of the nozzle 473 when sterilizing the body of the nozzle 473 using the sterilizing water squirted from the water discharge unit 479 (timing t20 to t22) is slower than the movement speed (the retreat speed) of the nozzle 473 of the physical washing process. Thereby, the body of the nozzle 473 is sterilized carefully and more efficiently. Also, in the case where the nozzle 473 is an expandable/contractible multi-stage nozzle, bacteria easily propagate on the portions of the joints between the adjacent cylinder units. Therefore, the portions of the joints between the adjacent cylinder units can be sterilized carefully and more efficiently by the control unit 405 causing the movement speed (the advance/retreat speed) of the nozzle 473 to be slower when the body of the nozzle 473 is sterilized.

Continuing, in the state in which the nozzle 473 is stored in the casing 400, the control unit 405 switches the flow rate switch valve 471 and the flow channel switch valve 472 from "bypass 3" to "SC2" and performs the post-wash by discharging the sterilizing water from all of the water discharge ports 474 for the "bottom wash" and the "bidet wash" (timing t22 to t23). At this time as well, the portion of the water discharge ports 474 of the nozzle 473 is sterilized by the sterilizing water because the solenoid valve 431 is opened by the control unit 405 and the control unit 405 provides the current to the electrolytic cell unit 450.

Thus, the sanitary washing apparatus 100 according to the embodiment can perform the post-wash and the body wash of the nozzle 473 using the sterilizing water produced in the electrolytic cell unit 450, that is, can execute the sterilizing process (timing t17 to t23). The flow rate when executing the sterilizing process is, for example, about 280 cc/minute as described above. That is, the water amount supplied when executing the sterilizing process (timing t17 to t23) is less than the water amount supplied when executing the physical washing process (timing t12 to t15).

In other words, the control unit 405 can execute the sterilizing process at a set flow rate independent of the flow rate when executing the private part wash and/or the physical washing process. More specifically, for example, the control unit 405 can detect the water quality (e.g., the electrical conductivity, etc.) of the service water from the voltage applied to the electrolytic cell unit 450 and control the flow rate by predicting the concentration of the chlorine ions inside the service water. Alternatively, for example, the control unit 405 can predict the propagation speed of the bacteria from the temperature inside the toilet room and control the flow rate by calculating the necessary concentration of the hypochlorous acid based on the propagation speed.

Also, the control unit 405 can execute the sterilizing process at a set temperature independent of the warm water temperature when executing the private part wash and/or the physical washing process. More specifically, for example, the control unit 405 can detect the water quality (e.g., the electrical conductivity, etc.) of the service water from the voltage applied to the electrolytic cell unit 450 and control the warm water temperature by predicting the concentration of the chlorine ions inside the service water. Alternatively, for example, the control unit 405 can predict the propagation speed of the bacteria from the temperature inside the toilet room and control the warm water temperature by calculating the necessary concentration of the hypochlorous acid based on the propagation speed.

Further, as described above, both the efficiency and the sustainability of the sterilization can be obtained according to the set temperature of the warm water heater 441 of the "sterilization control mode." Therefore, for example, the control unit 405 can set the warm water heater 441 to a temperature that is higher than that of the physical washing process when performing the sterilizing process (the post-wash) of timing t17 to t19 and the sterilizing process (the body wash) of timing t19 to t21 and can, on the other hand, set the warm water heater 441 to a temperature lower than that of the physical washing process when performing the sterilizing process (the body wash) of timing t21 to t22 and the sterilizing process (the post-wash) of timing t22 to t23. Thereby, the nozzle 473 can be sterilized efficiently using the sterilizing water having a higher concentration of the hypochlorous acid prior to or when the nozzle 473 is advanced from the casing 400; and on the other hand, the sterilization effect of the sterilizing water adhered to the surface of the nozzle 473 can be sustained longer when or after the nozzle 473 is stored in the casing 400.

Although the sanitary washing apparatus 100 performs the physical washing process prior to the user rising from the toilet seat 200 and performs the sterilizing process after the user rises from the toilet seat 200 in the specific example, this is not limited only thereto. For example, the sanitary washing apparatus 100 may perform the physical washing process and the sterilizing process as a series of operations after the user rises from the toilet seat 200. Alternatively, for example, the sanitary washing apparatus 100 may perform the physical washing process and the sterilizing process as a series of operations in the operation of the preparation of the warm water (timing t1 to t4). Even in such a case, the sterilizing water is not squirted onto the private parts of the user because the sterilizing water inside the flow channel 20 is replaced with newly-supplied water in the pre-wash and the body wash of timing t5 to t8. However, considering that there is a risk that the solid waste may adhere to the nozzle 473 when the user is seated on the toilet seat 200, it is more favorable for the body wash, in which the nozzle 473 is caused to advance and retreat, to be performed after the user rises from the toilet seat 200. Also, as described above in regard to FIG. 6, in the specific example as well, the operations of the physical washing process and the sterilizing process may be performed continuously.

According to the embodiment as described above, the sterilizing process to sterilize the nozzle 473 using the sterilizing water and the physical washing process to wash the nozzle 473 using the water can be executed. Then, the sanitary washing apparatus 100 can cause the condition caused by the concentration of the hypochlorous acid to be different between the case where the sterilizing process is executed and the case where the physical washing process is executed. Thereby, the nozzle 473 can be sterilized more efficiently. Also thereby, the user's sense of cleanliness regarding the nozzle 473 can be improved.

Although the temperature and/or the flow rate of the water are adjusted to cause the condition caused by the concentration of the hypochlorous acid to be different between the physical washing process and the sterilizing process in the specific examples described above, the concentration may be adjusted by adjusting the value of the current instead. Also, as an example of the case where an electrolytic cell is utilized as the sterilizing water supply unit, a method in which silver is eluted may be used. Alternatively, a method in which a bactericide is dissolved in water may be used; and a method that utilizes steam and/or hot water in which water is heated to a high temperature may be used. Also, in the sterilizing process, the inner wall of the nozzle wash chamber 478 also may be sterilized by spraying the sterilizing water from the water discharge unit 479 configured to wash the body portion in a mist when the nozzle 473 is stored in the nozzle wash chamber 478.

Hereinabove, embodiments of the invention are described. However, the invention is not limited to these descriptions. Appropriate design modifications made by one skilled in the art in regard to the embodiments described above also are within the scope of the invention to the extent that the features of the invention are included. For example, the configurations, the dimensions, the materials, the dispositions, etc., of the components included in the sanitary washing apparatus 100, etc., and the disposition methods, etc., of the nozzle 473 and the nozzle wash chamber 478 are not limited to those illustrated and may be modified appropriately.

Further, the components included in the embodiments described above can be combined within the extent of technical feasibility; and such combinations are included in the scope of the invention to the extent that the features of the invention are included.

INDUSTRIAL APPLICABILITY

According to an aspect of the invention, a sanitary washing apparatus in which the washing nozzle can be sterilized more efficiently or a user's sense of cleanliness regarding the washing nozzle can be improved is provided.

EXPLANATION OF REFERENCE

10 water supply source
20 flow channel
100 sanitary washing apparatus
200 toilet seat
300 toilet lib
310 transmissive window
400 casing
401 power source circuit
403 human body detection sensor
404 seat contact detection sensor
405 control unit
407 exhaust port
408 outlet
409 recessed portion
410 metal branch fitting
420 coupling hose
430 valve unit
431 solenoid valve
432 pressure adjustment valve
433 incoming water thermistor
434 safety valve
435 water drain cock
440 heat exchanger unit
441 warm water heater
442 vacuum breaker
450 electrolytic cell unit
451 anode plate
452 cathode plate
460 pressure modulation device
470 nozzle unit
471 flow rate switch valve
472 flow channel switch valve
473 nozzle
474 water discharge port
475 mount
476 nozzle motor
477 transmission member
478 nozzle wash chamber
479 water discharge unit
500 operation unit
800 toilet
801 bowl

The invention claimed is:

1. A sanitary washing apparatus, comprising:

a nozzle having a water discharge port, the nozzle being configured to wash a human private part by squirting water from the water discharge port;

a flow channel configured to supply the water to the nozzle;

a sterilizing water supply unit provided partway through the flow channel, the sterilizing water supply unit being capable of supplying sterilizing water including sterilizing components; and a control unit configured to execute a physical washing process of washing the nozzle using water and a sterilizing process of sterilizing the nozzle using the sterilizing water after the washing the human private part, the control unit causing a flow rate of the sterilizing water when executing the sterilizing process to be less than a flow rate of the water when executing the physical washing process.

2. The sanitary washing apparatus according to claim 1, wherein the sterilizing water supply unit is an electrolytic cell capable of producing the sterilizing water.

3. The sanitary washing apparatus according to claim 2, further comprising a heating unit provided in the flow channel upstream of the electrolytic cell, the heating unit being capable of heating the water, the control unit controlling the heating unit to cause a temperature of the water when executing the physical washing process to be different from a temperature of the sterilizing water when executing the sterilizing process.

4. The sanitary washing apparatus according to claim 1, further comprising a drive unit configured to cause the nozzle to advance and retreat, the control unit controlling the drive unit to cause an advance/retreat speed of the nozzle when executing the sterilizing process to be slower than an advance/retreat speed of the nozzle when executing the physical washing process.

5. The sanitary washing apparatus according to claim 1, wherein the control unit executes the physical washing process and the sterilizing process as a series of operations while interposing a time interval between the physical washing process and the sterilizing process.

* * * * *